US005392600A

United States Patent [19]

Nagai

[11] Patent Number: 5,392,600

[45] Date of Patent: Feb. 28, 1995

[54] SYSTEM FOR CONTROLLING AIR-FUEL RATIO IN INTERNAL COMBUSTION ENGINE AND METHOD OF THE SAME

[75] Inventor: Toshinari Nagai, Sizuoka, Japan

[73] Assignee: Toyota Jidosha Kabushiki Kaisha, Toyota, Japan

[21] Appl. No.: 187,554

[22] Filed: Jan. 28, 1994

[30] Foreign Application Priority Data

Feb. 3, 1993 [JP] Japan ..... 5-040523

[51] Int. Cl.[6] ..... F01N 3/20

[52] U.S. Cl. ..... 60/274; 60/276; 60/285; 123/703

[58] Field of Search ..... 60/274, 276, 277, 285; 123/672, 674, 703

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler | 60/276 |
| 4,817,383 | 4/1989 | Masui | 60/276 |
| 4,840,027 | 6/1989 | Okumura | 60/274 |
| 5,119,629 | 6/1992 | Kume | 60/274 |
| 5,154,055 | 10/1992 | Nakane | 60/276 |
| 5,157,920 | 10/1992 | Nakinawa | 60/274 |
| 5,261,230 | 11/1993 | Yuuki | 60/277 |

FOREIGN PATENT DOCUMENTS 63-195351 8/1988 Japan .

*Primary Examiner*—Ira S. Lazarus
*Assistant Examiner*—Daniel J. O'Connor
*Attorney, Agent, or Firm*—Oliff & Berridge

[57] ABSTRACT

The present invention provides an improved air-fuel ratio control system which eliminates a time lag of outputs of an outlet or second oxygen sensor at a high accuracy and adequately controls the air-fuel ratio, thus efficiently reducing an exhaust of harmful gases including HC, CO, and NOx and improving the fuel consumption. When an output voltage SOX of the second oxygen sensor is within a predetermined range between a first voltage E1 and a second voltage E2 including a reference voltage E0 corresponding to a stoichiometric air-fuel ratio, an update quantity DRSR of a rich skip amount RSR is equal to zero. When the output voltage SOX is in a range between a minimum output GSOXmin and the first voltage E1, the update quantity DRSR exponentially increases with the decrease in the voltage. When the output voltage SOX is in a range between the second voltage E2 and a maximum output GSOXmax, the update quantity DRSR exponentially decreases with the increase in the voltage. The rich skip amount RSR used in a main air-fuel ratio feed-back control is compensated with the update quantity DRSR thus determined. In the system of the invention, the air-fuel ratio is maintained in a desirable range to ensure a reduced exhaust of harmful gases when the output voltage SOX of the second oxygen sensor being within the predetermined range between E1 and E2, and rapidly approaches to a desirable target ratio for reduced emission of the exhaust gas when SOX is out of the predetermined range.

20 Claims, 11 Drawing Sheets

SYSTEM FOR CONTROLLING AIR-FUEL RATIO IN INTERNAL COMBUSTION ENGINE AND METHOD OF THE SAME

BACKGROUND OF THE INVENTION

1. Field of the Invention

The present invention relates to a system for controlling an air-fuel ratio in an internal combustion engine. The system includes a pair of specific concentration sensors, for example, a pair of oxygen sensors, positioned in an inlet side and an outlet side of a catalytic converter for detecting concentrations of a specific component in an exhaust gas for the purpose of feed-back control of the air-fuel ratio.

2. Description of the Related Art

A known double-oxygen sensor air-fuel ratio control system implements feed-back control of the air-fuel ratio with a first oxygen sensor positioned in an inlet side of a catalytic converter and a second oxygen sensor positioned in an outlet side of the catalytic converter. The second oxygen sensor in the outlet of the catalytic converter has a lower responsive speed but shows preferably little scatter in output characteristics. In the conventional double-oxygen sensor air-fuel ratio control system, some scatter in output characteristics of the first oxygen sensor can thus be eliminated according to the outputs of the second oxygen sensor, which effectively improves the accuracy in control of the air-fuel ratio.

The double-oxygen sensor air-fuel ratio control system executes an air-fuel ratio feed back control which balances the air-fuel ratio around a stoichiometric ratio through an integral control and a skip control according to output signals of the first oxygen sensor. During execution of the feed-back control, degrees of the integral control and the skip control are varied according to outputs of the second oxygen sensor. For example, a rich skip amount RSR for shifting the air-fuel ratio to the rich condition is adjusted according to the outputs of the second oxygen sensor.

The double-oxygen sensor air-fuel ratio control system, however, has such a problem that a time lag of lean and rich outputs from the second oxygen sensor due to the oxygen stored in the catalytic converter, that is, oxygen storage effects of the catalytic converter, undesirably lowers the accuracy of the air-fuel ratio control. To solve the problem, an improved air-fuel ratio control system has been proposed as disclosed in JAPANESE PATENT LAYING-OPEN GAZETTE No. 63-195351. The improved system calculates a deviation of the output of the second oxygen sensor from a reference output corresponding to a stoichiometric air-fuel ratio, and increases an update quantity ΔRS of the rich skip amount RSR per unit time in proportion to the increase in the deviation. This allows the air-fuel ratio to quickly approach to the stoichiometric ratio, thus compensating for a time lag of the outputs of the second oxygen sensor.

The inventors of the present invention have experimentally found a correlation of the outputs of the second oxygen sensor with the amounts of harmful substances contained in an exhaust emission as shown in FIG. 1. The correlation represents purification characteristics of the catalytic converter. As shown in FIG. 1, an output (voltage signal) SOX of the second oxygen sensor is within a predetermined range between a first voltage al (for example, 0.3 [V]) and a second voltage a2 (for example, 0.7 [V]) including a reference output level, there is relatively little emission of harmful exhausts, hydrocarbons (HC), carbon monoxide (CO), and nitrogen oxides (NOx). Exhausts of HC and CO drastically or exponentially increase when the output SOX exceeds the second voltage a2 while NOx abruptly increases when SOX becomes smaller than the first voltage al. Namely, when the output SOX of the second oxygen sensor is shifted from the predetermined range, harmful exhausts increase exponentially.

These findings show that ideal compensation characteristics of the air-fuel ratio compensation with respect to the output deviation of the second oxygen sensor are relatively small when the output SOX of the second oxygen sensor being within the predetermined range between a1 and a2 including the reference output level, and abruptly increase when the output SOX being out of the predetermined range as shown in FIG. 2. When the output SOX of the second oxygen sensor is within the predetermined range between al and a2 including the reference output level, small air-fuel ratio compensation preferably maintains a current desirable condition of reduced exhausts. When the output SOX of the second oxygen sensor is out of the predetermined range, on the contrary, abrupt increase in the air-fuel compensation quickly shifts the output SOX into the predetermined range between al and a2 for reduced emission of the exhaust gas.

The above conventional system, on the other hand, increases the rich skip amount RSR in proportion to the output deviation of the second oxygen sensor as shown by the two-doted chain line in FIG. 2. The compensation characteristics of the conventional system are compared with the ideal compensation characteristics described above. When the output SOX of the second oxygen sensor is within a certain range between b1 and b2 including the reference output level, which is wider than the predetermined range between a1 and a2, the air-fuel ratio is compensated excessively. When the output SOX is shifted from the certain range, on the other hand, the air-fuel ratio is compensated insufficiently. These problems of the conventional system result in the undesirable increase in the exhaust emission, the low drivability and the low fuel consumption.

SUMMARY OF THE INVENTION

One object of the present invention is accordingly to prevent excessive or insufficient compensation of an air-fuel ratio control based on an outlet concentration sensor so as to eliminate a time lag of an output of the outlet concentration sensor at a high accuracy and adequately control the air-fuel ratio of an internal combustion engine.

Another object of the invention is to sufficiently compensate for a reduced output of a concentration sensor due to a long-term change so as to adequately control the air-fuel ratio.

The above and other related objects are realized by an air-fuel ratio control system for controlling an air-fuel ratio of an internal combustion engine. The system of the invention includes a catalytic converter positioned in an exhaust conduit of the internal combustion engine, a first concentration sensor disposed in an inlet position of the catalytic converter for detecting a first concentration of a specific component varying with change in an air-fuel ratio reflected in an exhaust gas; a second concentration sensor disposed in an outlet position of the catalytic converter for detecting a second concentration of the specific component varying with change in the air-fuel ratio reflected in the exhaust gas; a control unit for updating a first control amount corresponding to the first concentration of the specific component detected by the first concentration sensor, updating a second control amount corresponding to the second concentration of the specific component detected by the second concentration sensor, and controlling the air-fuel ratio of the internal combustion engine to a predetermined target air-fuel ratio according to the first and second control amounts; a memory unit for previously storing correlation data representing a relationship between an air-fuel ratio at the outlet position where the second concentration sensor is disposed and an update quantity of the second control amount per unit time, which are correlated with each other in response to purification characteristics of the exhaust gas by the catalytic converter; and a second control update unit for determining, based on the correlation data stored in the memory unit, the update quantity of the second control amount per unit time corresponding to the second concentration of the specific component detected by the second concentration sensor, so as to regulate the control unit to update the second control amount based on the update quantity per unit time.

Both the first concentration sensor and the second concentration sensor are preferably oxygen sensors for respectively detecting concentrations of oxygen in the exhaust gas.

The correlation data stored in the memory unit shows a minimum of the update quantity of the second control amount per unit time when the second concentration of the specific component detected by the second concentration sensor is within a predetermined range including a reference concentration corresponding to a stoichiometric air-fuel ratio.

In a preferred application, the correlation data stored in the memory unit shows an abrupt exponential change in the update quantity of the second control amount per unit time when the second concentration of the specific component detected by the second concentration sensor is out of a predetermined range including a reference concentration corresponding to a stoichiometric air-fuel ratio.

In another application, the correlation data stored in the memory unit may show a minimum of the update quantity of the second control amount per unit time when the second concentration of the specific component detected by the second concentration sensor is within a predetermined range including a reference concentration corresponding to a stoichiometric air-fuel ratio, and shows an abrupt exponential change in the update quantity of the second control amount per unit time when the second concentration of the specific component is out of the predetermined range.

The first control amount updated by the control unit preferably includes a skip amount which skippingly varies an air-fuel ratio compensation and an integral amount which gradually varies the air-fuel ratio compensation, and the second control amount updated by the control unit includes a skip compensation which compensates for the skip amount.

The skip compensation compensates a rich skip amount which varies the air-fuel ratio to a rich condition or alternatively a lean skip amount which varies the air-fuel ratio to a lean condition.

In one preferred application, the system of the invention may further include a learning system for learning a maximum and a minimum of the second concentration of the specific component detected by the second concentration sensor. In such a structure, the second control update unit is provided with an update quantity determination unit for calculating at least one of first and second differences, said first difference being between said maximum and the second concentration of said specific component detected by said second concentration sensor, said second difference being between said minimum and said second concentration, and determining the update quantity of said second control amount per unit time based on said differences.

In another application, the system my further include a start-up detection unit for detecting a start-up of the internal combustion engine, and a clear unit for clearing the maximum and the minimum of the second concentration of the specific component learnt by the learning unit when a start-up of the internal combustion engine is detected.

It is preferable that the learning system includes; a first decision unit for determining whether the internal combustion engine is under such an operating condition that fuel injection increases for the purpose of preventing an abnormal overheat; a maxim learning unit for learning the maximum of the second concentration of the specific component only when the first decision unit determines an increase in the fuel injection; a second decision unit for determining whether the internal combustion engine is under a fuel-cut condition; and a minimum learning unit for learning the minimum of the second concentration of the specific component only when the second decision unit determines a fuel-cut condition.

The present invention is also directed to a method of controlling an air-fuel ratio in an internal combustion engine. The method of the invention includes the steps of: (a) detecting a first concentration of a specific component varying with change in an air-fuel ratio reflected in an exhaust gas at an inlet position of a catalytic converter positioned in an exhaust conduit of the internal combustion engine; (b) detecting a second concentration of the specific component varying with change in the air-fuel ratio reflected in the exhaust gas at an outlet position of the catalytic converter; (c) updating a first control amount corresponding to the first concentration of the specific component detected in the step (a), updating a second control amount corresponding to the second concentration of the specific component detected in the step (b), and controlling the air-fuel ratio of the internal combustion engine to a predetermined target air-fuel ratio according to the first and second control amount s; (d) previously storing correlation data representing a relationship between an air-fuel ratio at the outlet position for detection in the step (b) and an update quantity of the second control amount per unit time, which are correlated with each other in response to purification characteristics of the exhaust gas by the catalytic converter; and (e) determining, based on the correlation data stored in the step (d), the update quantity of the second control amount per unit time corresponding to the second concentration of the specific component detected in the step (b), so as to regulate updating of the second control amount executed in the step (c) based on the update quantity per unit time.

These and other objects, features, aspects, and advantages of the present invention will become more apparent from the following detailed description of the preferred embodiment with the accompanying drawings.

DESCRIPTION OF PREFERRED EMBODIMENT

The structure and function of the invention will become more apparent through description of a preferred embodiment according to the invention.

Figure 1A:
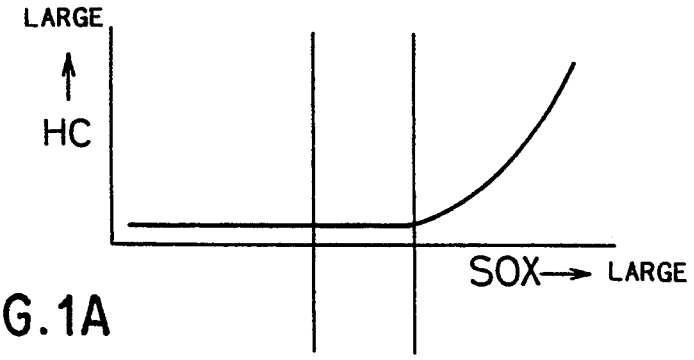
FIG. 1 is a graph illustrating a correlation of output values SOX of a second oxygen sensor with amounts of exhaust emission.
Figure 1B:
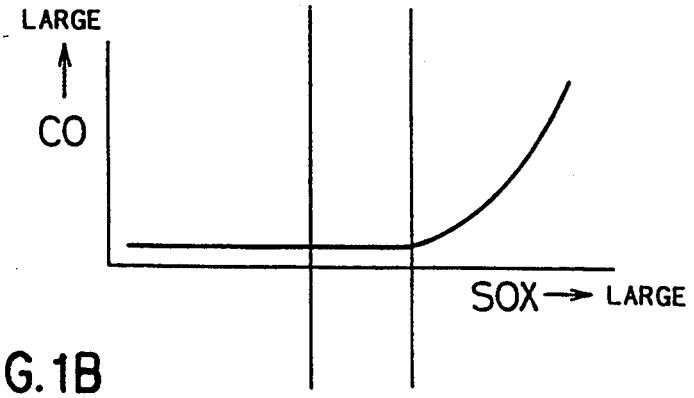
Figure 1C:
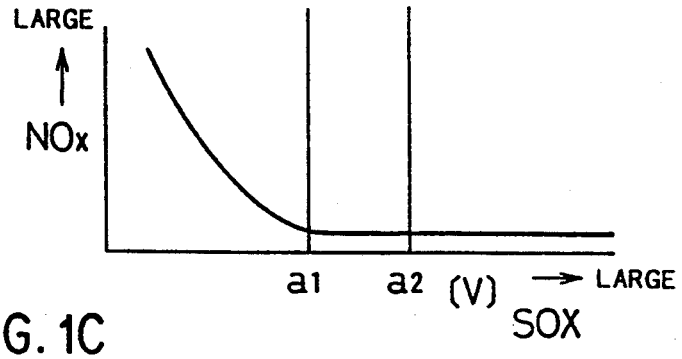
Figure 2:
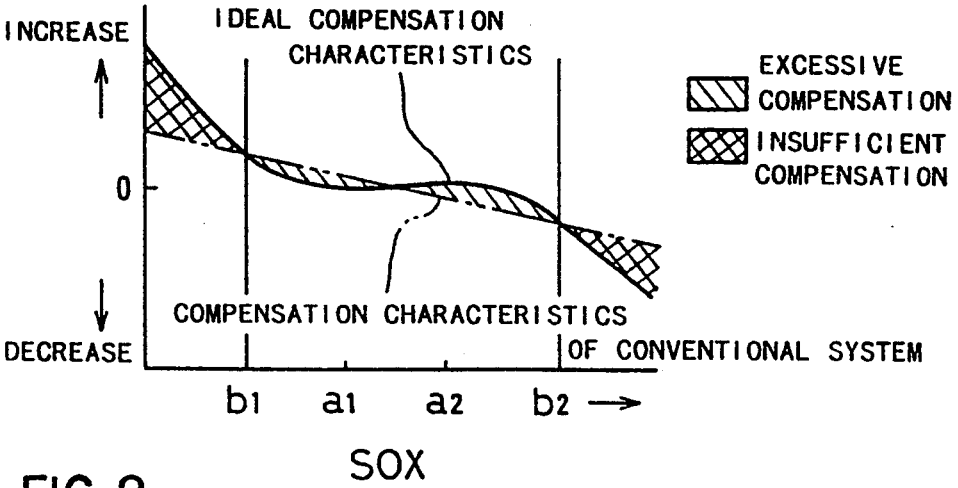
FIG. 2 is a graph showing ideal compensation characteristics corresponding to the output value SOX of the second oxygen sensor.
Figure 3:
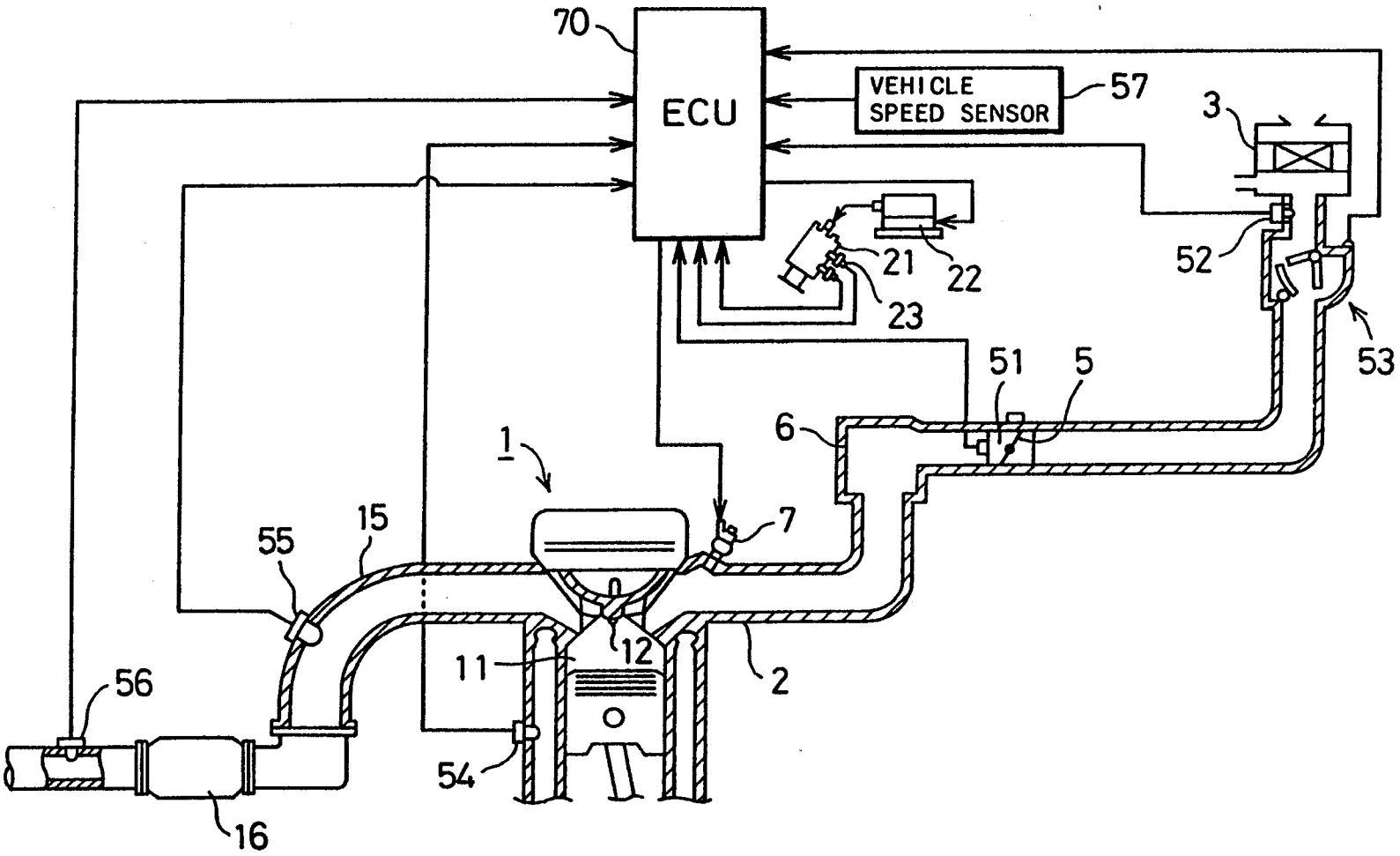
FIG. 3 schematically illustrates an automobile engine with an air-fuel ratio control system as an embodiment according to the invention and peripheral devices.

FIG. 3 schematically illustrates an automobile engine with an air-fuel ratio control system as an embodiment according to the invention and peripheral devices.

An air intake conduit 2 of an automobile engine 1 is provided with an air inlet for receiving an intake air, an air cleaner 3, a throttle valve 5, a surge tank 6 for reducing a pulsation of the intake air, and a fuel injection valve 7 for supplying a fuel to the engine 1.

The intake air supplied through the air intake conduit 2 is mixed with a gaseous fuel injected from the fuel injection valve 7 and fed into a combustion chamber 11 in the engine 1. A mixture of the intake air and gaseous fuel (hereinafter referred to as air-fuel mixture) is ignited with an ignition plug 12 in the combustion chamber 11 to actuate the engine 1. Combustion byproducts in the combustion chamber 11 are led to a three-way catalytic converter 16 via an exhaust conduit 15 to be purified and discharged as an exhaust gas to the atmosphere.

A high voltage is applied from an igniter 22 to the ignition plug 12 via a distributor 21 at a certain timing, which consequently determines an ignition timing. The distributor 21 distributes a high voltage generated by the igniter 22 to an ignition plug 12 of each cylinder, and is provided with a rotational speed sensor 23 for outputting 24 pulse signals per rotation.

The engine 1 is further provided with a variety of sensors for detecting driving conditions as well as the rotational speed sensor 23. These sensors include a throttle position sensor 51 for detecting an opening of the throttle valve 5 and having a built-in idle switch (see FIG. 4) for detecting a full-close position of the throttle valve 5, an air temperature sensor 52 positioned in the air intake conduit 2 for detecting a temperature of the intake air, an air flowmeter 53 for detecting an amount of the intake air, a water temperature sensor 54 positioned in a cylinder block for detecting a temperature of cooling water, a first oxygen sensor 55 positioned in an inlet side of the catalytic converter 16 in the exhaust conduit 15 for detecting a concentration of oxygen in the exhaust gas, a second oxygen sensor 56 positioned in an outlet side of the catalytic converter 16 in the exhaust conduit 15 for detecting a concentration of oxygen in the exhaust gas, and a vehicle speed sensor 57 for detecting a speed V of a vehicle. Both the first oxygen sensor 55 and the second oxygen sensor 56 provide an output signal which shifts rather abruptly between two voltage levels with small changes in the air- fuel ratio around a stoichiometric ratio.

Detection signals from the variety of sensors described above are input into an electronic control unit (hereinafter referred to as ECU) 70.

Figure 4:
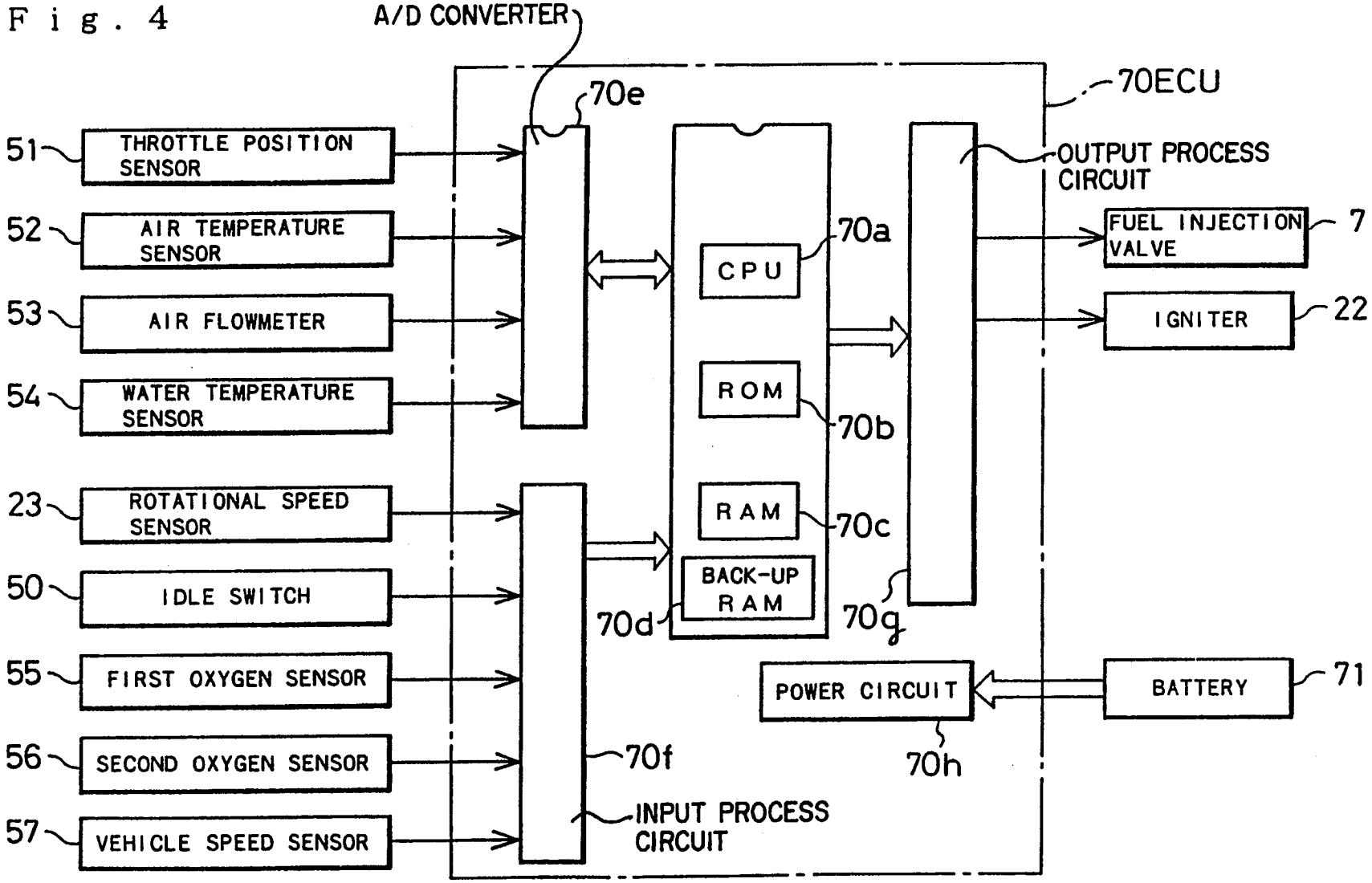
FIG. 4 is a block diagram showing an electrical structure of a control system including an ECU.

As clearly seen in FIG. 4, the ECU 70 is constructed as a logic operation circuit having a micro-computer and includes a CPU (central processing unit) 70*a* for executing a variety of operations to control the engine 1, a ROM (read only memory) 70*b* for storing control programs and control data required for execution of the variety of operations by the CPU 70*a*, a RAM (random access memory) 70*c* for temporarily writing and reading various data required for execution of the variety of operations by the CPU 70*a*, a back-up RAM 70*d* for storing data under power-off conditions, an A/D converter 70*e* and an input process circuit 70*f* for receiving detection signals from the variety of sensors described above, and an output process circuit 70*g* for outputting driving signals to the fuel injection valve 7 and the igniter 22 according to results of the operations by the CPU 70*a*. The ECU 70 also includes a power circuit 70*h* connected to a battery 71 to allow a high voltage to be applied from the output process circuit 70*g*.

The ECU 70 thus constructed drives and controls the fuel injection valve 7 and the igniter 22 according to the driving conditions of the engine 1 so as to control the fuel injection, the ignition timing, and the air-fuel ratio.

Figure 5:
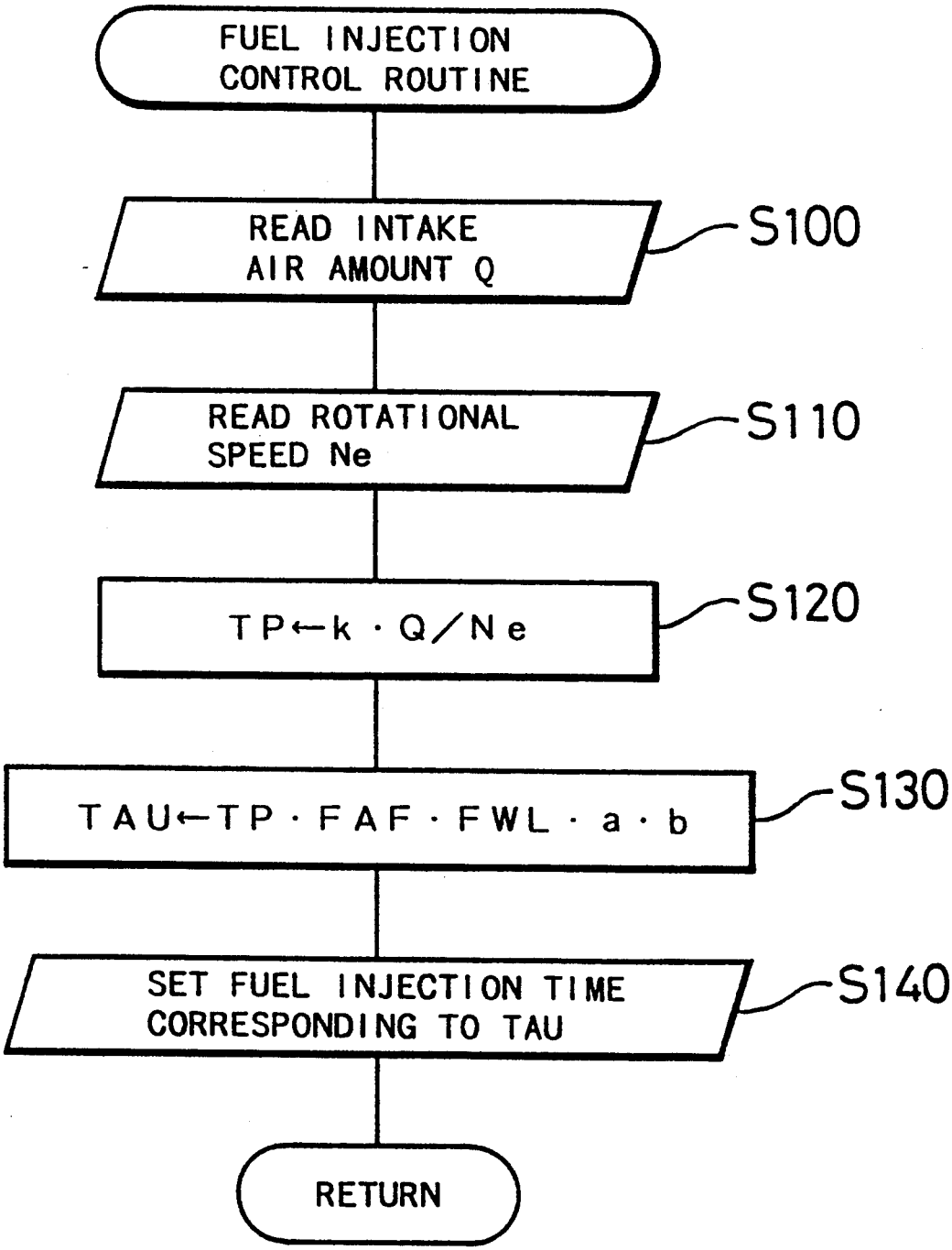
FIG. 5 is a flowchart showing a fuel injection control routine executed by a CPU in the ECU.

A fuel injection control routine executed by the CPU 70*a* of the ECU 70 is explained based on the flowchart of FIG. 5. The fuel injection control routine is executed at every predetermined crank angle, for example, 360 CA.

When the program enters the routine, the CPU 70*a* first reads an intake air amount Q, detected by the air flowmeter 53 and analog-digital converted by the A/D converter 70*e*, out of the RAM 70*c* at step S100. The CPU 70*a* then reads a rotational speed Ne, detected by the rotational speed sensor 23 and input via the input process circuit 70*f*, out of the RAM 70*c* at step S110. The intake air amount Q and the rotational speed Ne are previously stored in the RAM 70*c* according to respective interruption routines (not shown). Other values detected by the above sensors and mentioned below are also previously stored in the RAM 70*c* by other interruption routines (not shown).

The program then proceeds to step S120 at which the CPU 70*a* determines a standard fuel injection amount TP by substituting the intake air amount Q and the rotational speed Ne in an equation expressed as:

$$TP = k\ Q/Ne \quad (1)$$

where k is a constant.

At step S130, the CPU 70*a* determines an actual fuel injection amount TAU by multiplying the standard fuel injection amount TP by a plural compensation coefficients according to an equation written as:

$$TAU = TP\ FAF\ FWL\ a\ b \quad (2)$$

where FAF represents an air-fuel ratio compensation coefficient determined in a main air-fuel ratio feed-back control routine described later; FWL shows a warm-up increase compensation coefficient and is set equal to or greater than 1.0 while the temperature of cooking water THW is not higher than 60° C.; and a and b are other compensation coefficients, for example, an air temperature compensation coefficient, a transient state compensation coefficient, and a power voltage compensation coefficient.

After determination of the actual fuel injection amount TAU at step S130, the program goes to step S140 at which the CPU 70*a* sets a fuel injection time corresponding to the actual fuel injection amount TAU in a counter (not shown) to determine an opening time of the fuel injection valve 7. The fuel injection valve 7 is thus activated to be open during the opening time set in the counter. The program then goes to RETURN to exit from the routine.

Figure 6:
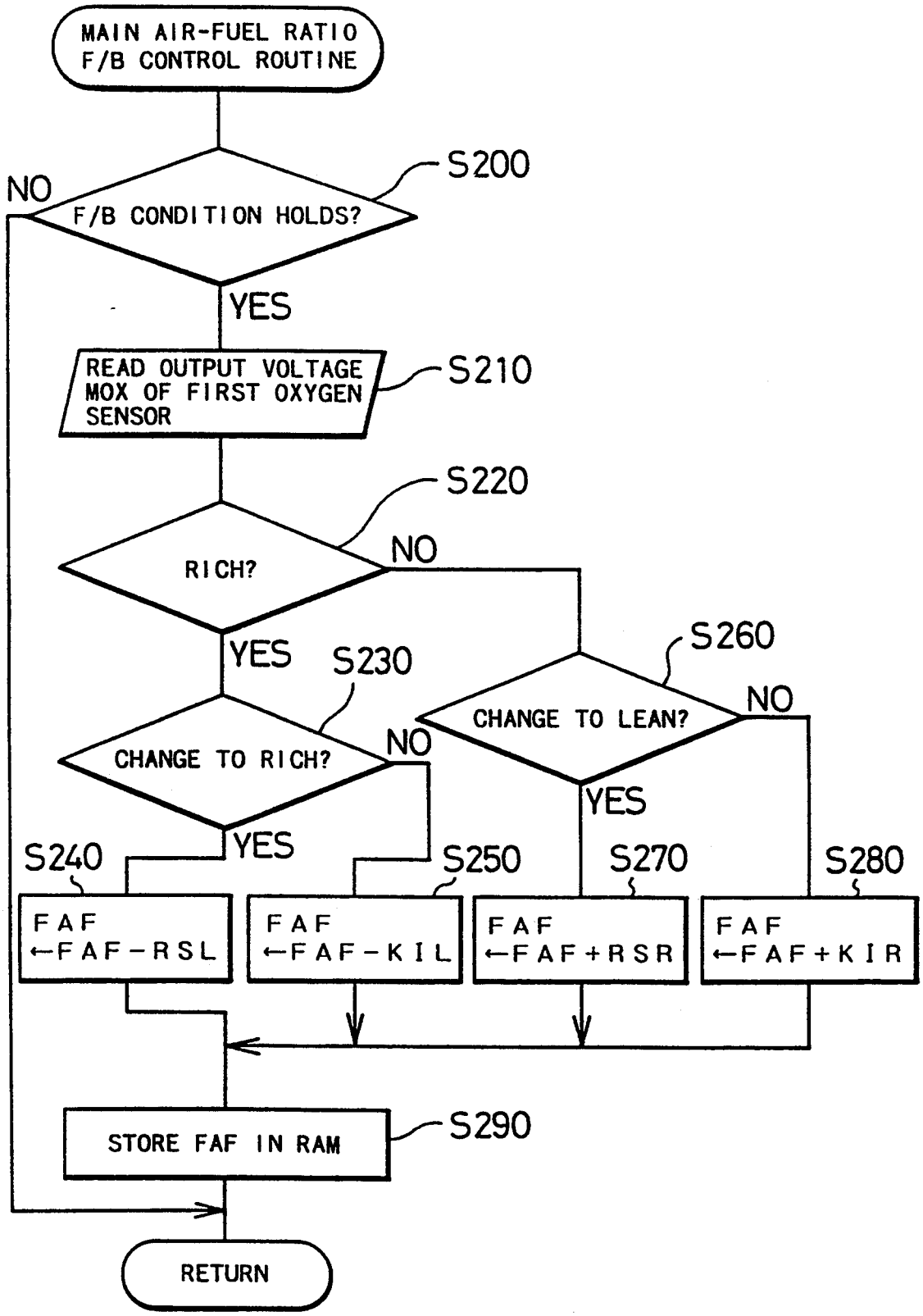
FIG. 6 is a flowchart showing a main air-fuel ratio feed-back control routine also executed by the CPU.

A main air-fuel ratio feed-back control routine executed by the CPU 70*a* of the ECU 70 is explained based on the flowchart of FIG. 6. Hereinafter feed-back may be referred to as F/B. The main air-fuel ratio F/B control routine for feed/back control of the air-fuel ratio according to an output voltage MOX of the first oxygen sensor 55 is executed as interrupting at every predetermined time interval, for example, 4 millisecond.

When the program enters the routine, the CPU 70*a* first determines whether an F/B condition of the air-fuel ratio is fulfilled at step S200. The F/B condition fails, for example, when the temperature of cooling water THW is not higher than a predetermined value, during an engine start-up, an initial increase in the fuel injection, or a power-up operation. When the F/B condition is determined to fail at step S200, the CPU 70*a* does not execute the main air-fuel ratio F/B control routine and the program exits from the routine.

When the F/B condition is determined to hold at step S200, on the contrary, the program goes to step S210 at which the CPU 70*a* reads the output voltage MOX of the first oxygen sensor 55 input via the input process circuit 70*f*, out of the RAM 70*c*. The CPU 70*a* then determines whether the air-fuel ratio is in a rich condition according to the output voltage MOX at step S220. In this embodiment, the air-fuel ratio is determined to be in the rich condition when the output voltage MOX is greater than a predetermined threshold level, 0.45 [V].

When the air-fuel ratio is determined to be rich at step S220, the program goes to step S230 at which the CPU 70*a* determines whether the air-fuel ratio changes from lean to rich. When the answer is YES at step S230, the program goes to step S240 at which the CPU 70*a* subtracts a lean skip amount RSL (RSL>0) from the air-fuel ratio compensation coefficient FAF. When the answer is NO at step S230, on the other hand, the program proceeds to step S250 at which the CPU 70*a* subtracts a lean integral amount KIR (KIR>0) from the air-fuel ratio compensation coefficient FAF. The lean skip amount RSL is set to be sufficiently greater than the lean integral amount KIR.

When the air-fuel ratio is determined to be lean at step S220, the program goes to step S260 at which the CPU 70*a* determines whether the air-fuel ratio changes from rich to lean. When the answer is YES at step S260, the program goes to step S270 at which the CPU 70*a* adds a rich skip amount RSR (RSR>0) to the air-fuel ratio compensation coefficient FAF. When the answer is NO at step S260, on the other hand, the program proceeds to step S280 at which the CPU 70*a* adds a rich integral amount KIR (KIR>0) to the air-fuel ratio compensation coefficient FAF. The rich skip amount RSR is set to be sufficiently greater than the rich integral amount KIR.

The air-fuel ratio compensation coefficient FAF operated at one of steps S240, S250, S270, and S280 is stored in the RAM 70*c* at step S290. The program then goes to RETURN to exit from the routine.

Figure 7A:
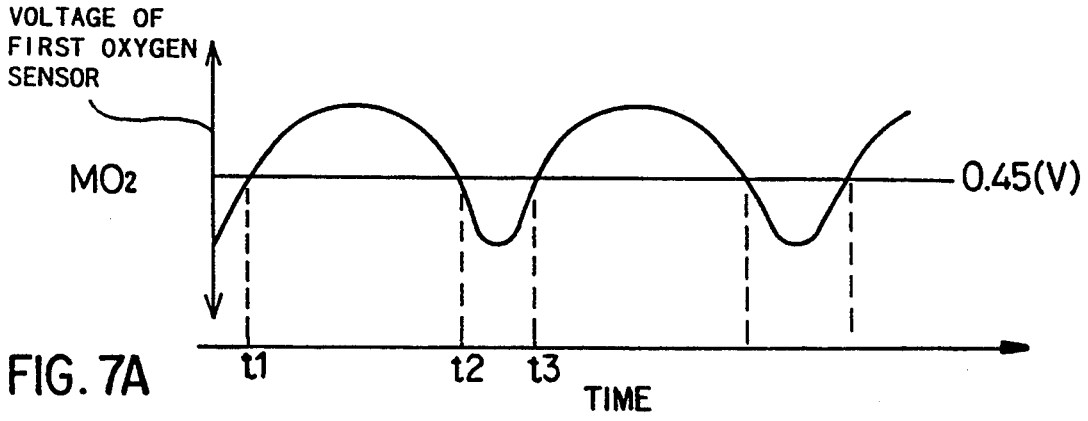
FIG. 7 is a timing chart showing contents of the main air-fuel ratio feed-back control routine.
Figure 7B:
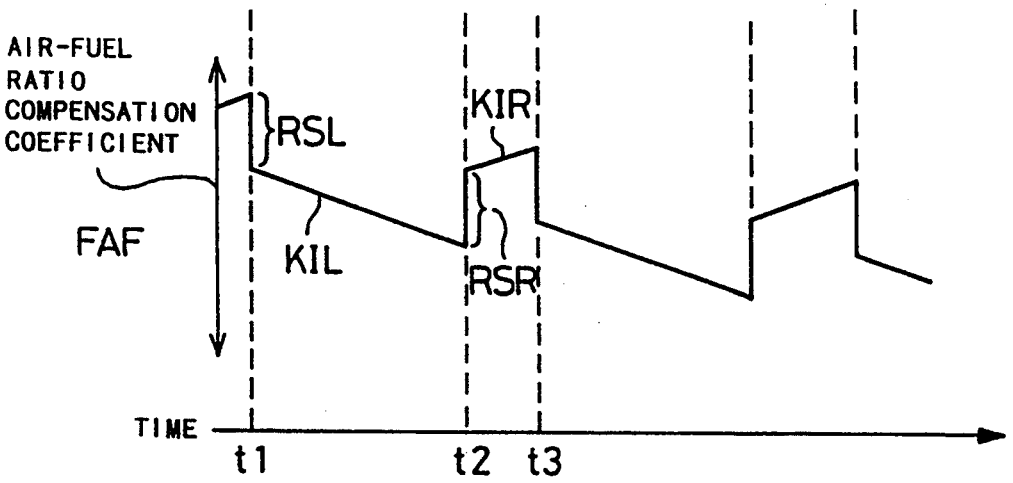

The process executed at step S250 or S280 is generally referred to as an integral control whereas the process executed at step S240 or S270 is referred to as a skip control. The air-fuel ratio is balanced around the stoichiometric ratio through the integral control and the skip control. FIG. 7 is a timing chart showing an example of the main air-fuel ratio feed-back control. In the timing chart of FIG. 7, when the output voltage MOX of the first oxygen sensor 55 exceeds the threshold level 0.45 [V] to become a rich condition at a time point t1, the CPU 70*a* receiving a rich signal representing the above condition decreases the air-fuel ratio compensation coefficient FAF steppingly by the lean skip amount RSL and then lowers the coefficient FAF gradually by the lean integral amount KIR. This results in a decrease in the actual fuel injection amount TAU, which consequently makes the air-fuel ratio leaner than the stoichiometric ratio and makes the output voltage MOX of the first oxygen sensor 55 smaller than the threshold level 0.45 [v] at a time point t2.

The CPU 70*a* receiving the output voltage MOX smaller than the threshold level 0.45 [V] increases the air-fuel ratio compensation coefficient FAF steppingly by the rich skip amount RSR and then raises the coefficient FAF gradually by the rich integral amount KIR. This results in an increase in the actual fuel injection amount TAU, which consequently makes the air-fuel ratio richer than the stoichiometric ratio and makes the output voltage MOX of the first oxygen sensor 55 greater than the threshold level 0.45 [V] at a time point t3. The air-fuel ratio is continuously exposed to a negative feed-back control through repetition of the above processes, and effectively balanced around the stoichiometric ratio.

Figure 8:
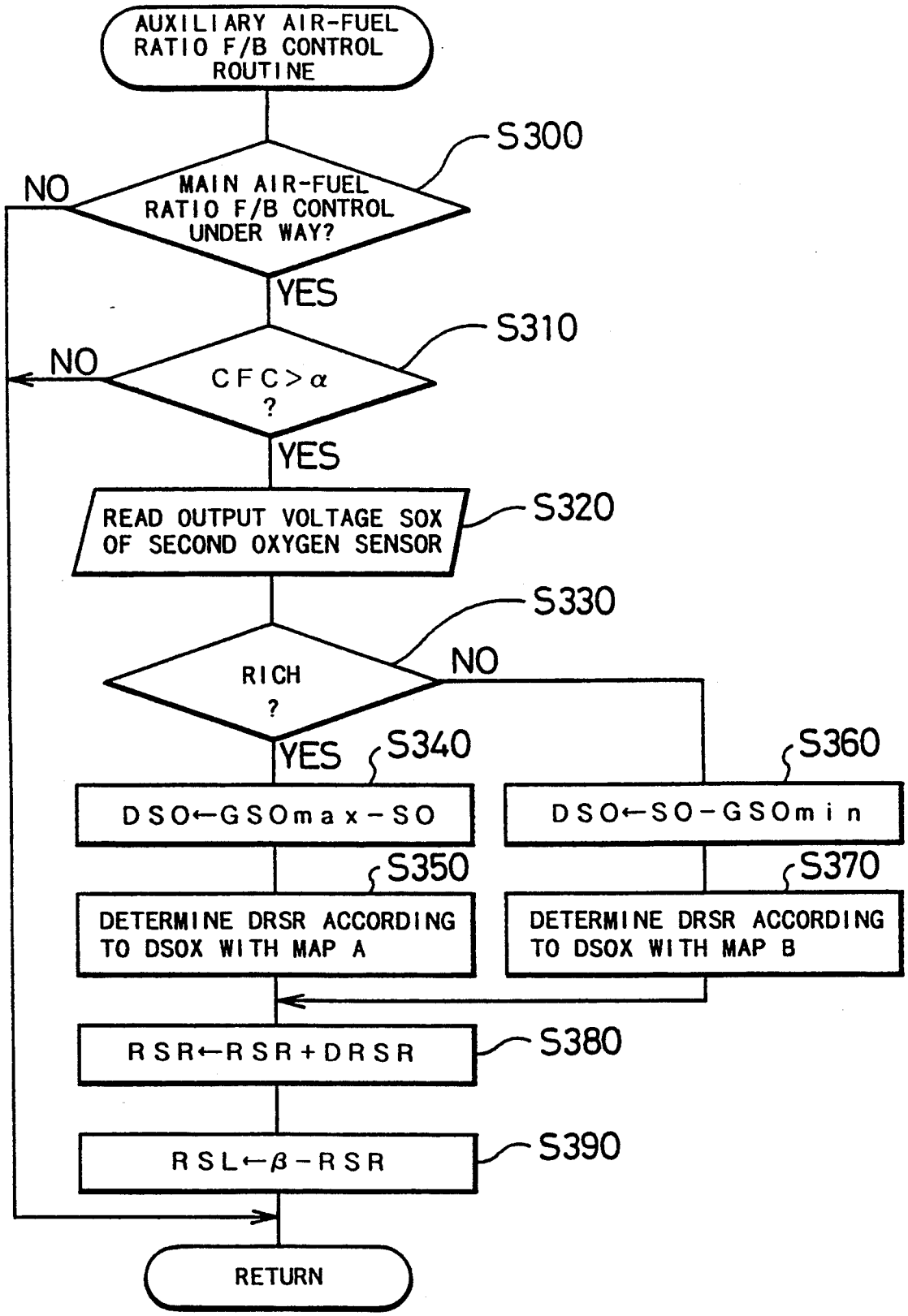
FIG. 8 is a flowchart showing an auxiliary air-fuel ratio feed-back control routine executed by the CPU.

An auxiliary air-fuel ratio feed-back control routine executed by the CPU 70*a* of the ECU 70 is explained based on the flowchart of FIG. 8. The auxiliary air-fuel ratio F/B control routine is executed for feed-back control of the air-fuel ratio based on an output voltage SOX of the second oxygen sensor 56. More concretely, the auxiliary air-fuel ratio F/B control routine indirectly implements the feed-back control of the air-fuel ratio by compensating the rich skip amount RSR and the lean skip amount RSL determined in the main air-fuel ratio F/B control routine according to the output voltage SOX of the second oxygen sensor 56. The auxiliary control routine is executed as interrupting at every predetermined time interval which is sufficiently greater than the predetermined time interval of the main air-fuel ratio F/B control routine, for example, 512 millisecond.

When the program enters the routine, the CPU 70*a* first determines whether the main air-fuel ratio F/B control according to the main air-fuel ratio F/B control routine is being executed at step S300. When the answer is YES, the program proceeds to step S310 at which the CPU 70*a* determines whether a counter CFC representing a time elapse after a fuel-cut operation becomes equal to or greater than a predetermined value α. The CPU 70*a* determines conditions for executing the auxiliary air-fuel ratio F/B control at steps S300 and S310. The executing conditions are fulfilled when a predetermined time has elapsed since a fuel-cut operation while the main air-fuel ratio F/B control is under way. The executing conditions fail, on the contrary, when the main air-fuel ratio F/B control is determined not to be under way at step S300 or when the predetermined time has not elapsed yet since a fuel-cut operation at step S310.

The executing conditions may further include that the engine 1 has been warmed up completely (the temperature of the cooling water is in a range between 60° C. and 80° C.), that the second oxygen sensor 56 has been activated, and that an output signal LL of the idle switch 50 is set equal to zero, that is, set in a non-idling state. When the executing conditions of the auxiliary air-fuel ratio F/B control fail at either step S300 or step S310, the program goes to RETURN to exit from the routine.

When the executing conditions of the auxiliary air-fuel ratio F/B control are determined to hold at steps S300 and S310, on the contrary, the program goes to step S320 at which the CPU 70*a* reads the output voltage SOX of the second oxygen sensor 56 input via the input process circuit 70*f*, out of the RAM 70*c*. At step S330, the CPU 70*a* determines whether the air-fuel ratio is in a rich condition according to the output voltage SOX. In this embodiment, the air-fuel ratio is determined to be in the rich condition when the output voltage SOX is greater than a predetermined threshold level, 0.45 [V].

When the air-fuel ratio is determined to be rich at step S330, the program goes to step S340 at which the CPU 70*a* determines a difference DSOX between a maximum GSOXmax of the output voltage SOX of the second oxygen sensor 56 and the actual output voltage SOX of the second oxygen sensor 56 read at step S320 according to an equation expressed as:

$$DSOX = GSOXmax - SOX \quad (3)$$

where the maximum GSOXmax represents a maximum output of the second oxygen sensor 56 in a predetermined time period from an engine start-up to an engine stop, and is determined in a learning routine described later.

Figure 9:
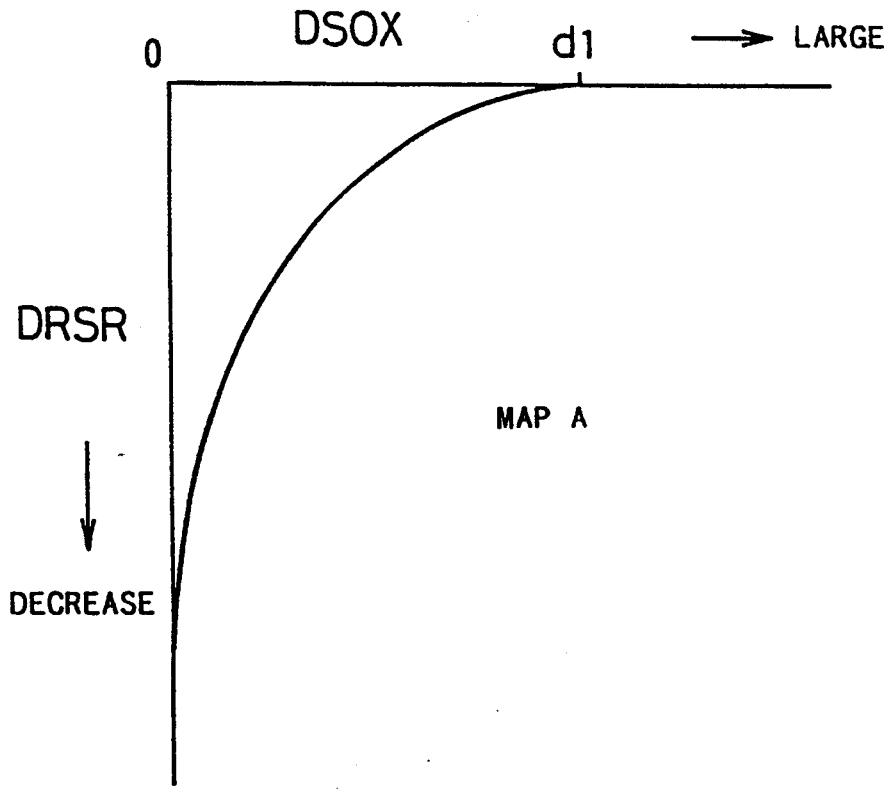
FIG. 9 is a graph showing a correlation of a difference DSOX with a skip update quantity DRSR under the rich condition.

At step S350, the CPU 70*a* determines a skip update quantity DRSR according to the difference DSOX determined at step S340. The skip update quantity DRSR represents an update quantity of the rich skip amount RSR per unit time, where the rich skip amount RSR is determined in the main air-fuel ratio F/B control routine described above. A map A representing a correlation of the difference DSOX with the skip update quantity DRSR under the rich condition is previously stored in the ROM 70*b* of the ECU 70. At step S350, the CPU 70*a* compares the difference DSOX determined at step S340 with the map A to determine the skip update quantity DRSR. FIG. 9 is a graph showing a typical example of the map A. As clearly seen in FIG. 9, the skip update quantity DRSR gives a negative value having an absolute maximum (in a decreasing direction) when the difference DSOX is equal to zero, exponentially increases in a range between 0 and a specific value d1 of the difference DSOX, and becomes equal to zero when the difference DSOX is equal to the specific value d1. When the difference DSOX is greater than the specific value d1, the skip update quantity DRSR is maintained at the value '0'.

When the air-fuel ratio is determined not to be rich, that is, to be lean at step S330, on the other hand, the program goes to step S360 at which the CPU 70*a* determines a difference DSOX between the actual output voltage SOX of the second oxygen sensor 56 read at step S320 and a minimum GSOXmin of the output voltage SOX of the second oxygen sensor 56 according to an equation expressed as:

$$DSOX = SOX - GSOXmin \quad (4)$$

where the minimum GSOXmin represents a minimum output of the second oxygen sensor 56 in a predetermined time period from an engine start-up to an engine stop, and is determined in the learning routine described later.

Figure 10:
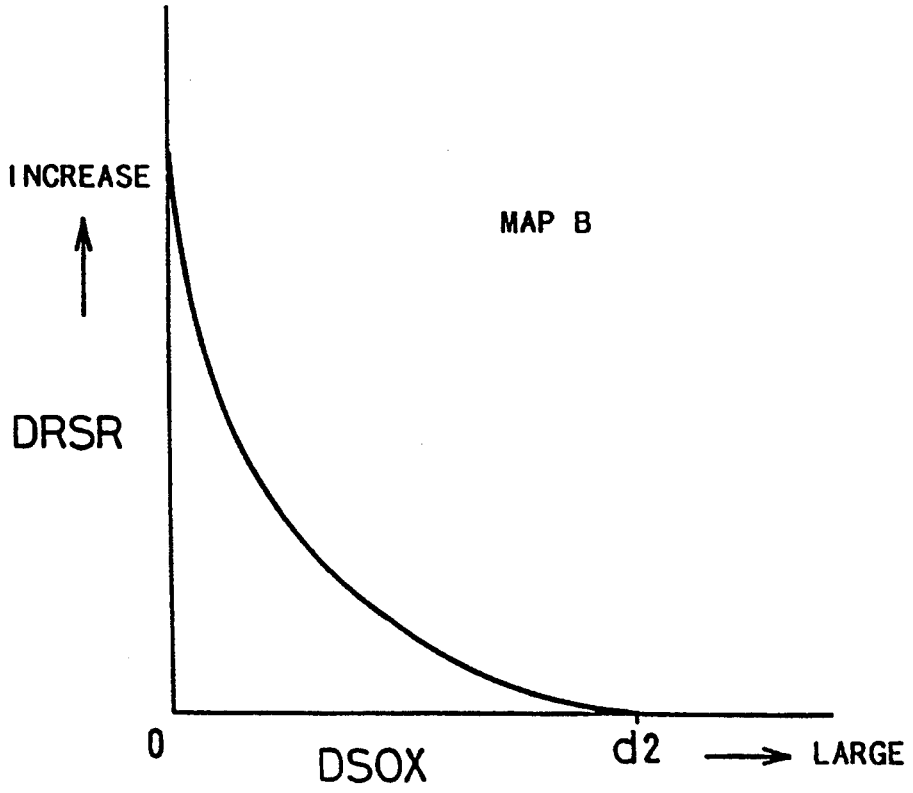
FIG. 10 is a graph showing a correlation of the difference DSOX with the skip update quantity DRSR under the lean condition.

At step S370, the CPU 70*a* determines a skip update quantity DRSR according to the difference DSOX determined at step S360. A map B representing a correlation of the difference DSOX with the skip update quantity DRSR under the lean condition is previously stored in the ROM 70*b* of the ECU 70. At step S370, the CPU 70*a* compares the difference DSOX determined at step S360 with the map B to determine the skip update quantity DRSR. FIG. 10 is a graph showing a typical example of the map B. As clearly seen in FIG. 10, the skip update quantity DRSR gives a positive value having an absolute maximum (in an increasing direction) when the difference DSOX is equal to zero, exponentially decreases in a range between 0 and a specific value d2 (=d1) of the difference DSOX, and becomes equal to zero when the difference DSOX is equal to the specific value d2. When the difference DSOX is greater than the specific value d2, the skip update quantity DRSR is maintained at the value '0'.

After execution of step S350 or step S370, the program goes to step S380 at which the rich skip amount RSR is updated by the skip update quantity DRSR according to an operation written as:

$$RSR = RSR + DRSR.$$

The rich skip amount RSR decreases under the rich condition where the skip update quantity DRSR is negative and increases under the lean condition where the skip update quantity DRSR is positive.

The program then proceeds to step S390 at which the CPU 70*a* determines the lean skip amount RSL according to an operation expressed as:

$$RSL = B - RSR$$

where $\beta$ shows a predetermined value representing a total of the rich skip amount RSR and the lean skip amount RSL. The program then goes to RETURN to exit from the routine.

In the auxiliary air-fuel ratio F/B control routine described above, when the air-fuel ratio is determined to be in the rich condition according to the output voltage SOX of the second oxygen sensor 56, the CPU 70*a* compares the difference DSOX between the output voltage SOX and the maximum output GSOXmax with the map A shown in FIG. 9 to determine the skip update quantity DRSR in the decreasing direction. When the air-fuel ratio is determined to be in the lean condition according to the output voltage SOX, on the contrary, the CPU 70*a* compares the difference DSOX between the output voltage SOX and the minimum output GSOXmin with the map B shown in FIG. 10 to determine the skip update quantity DRSR in the increasing direction.

Figure 11:
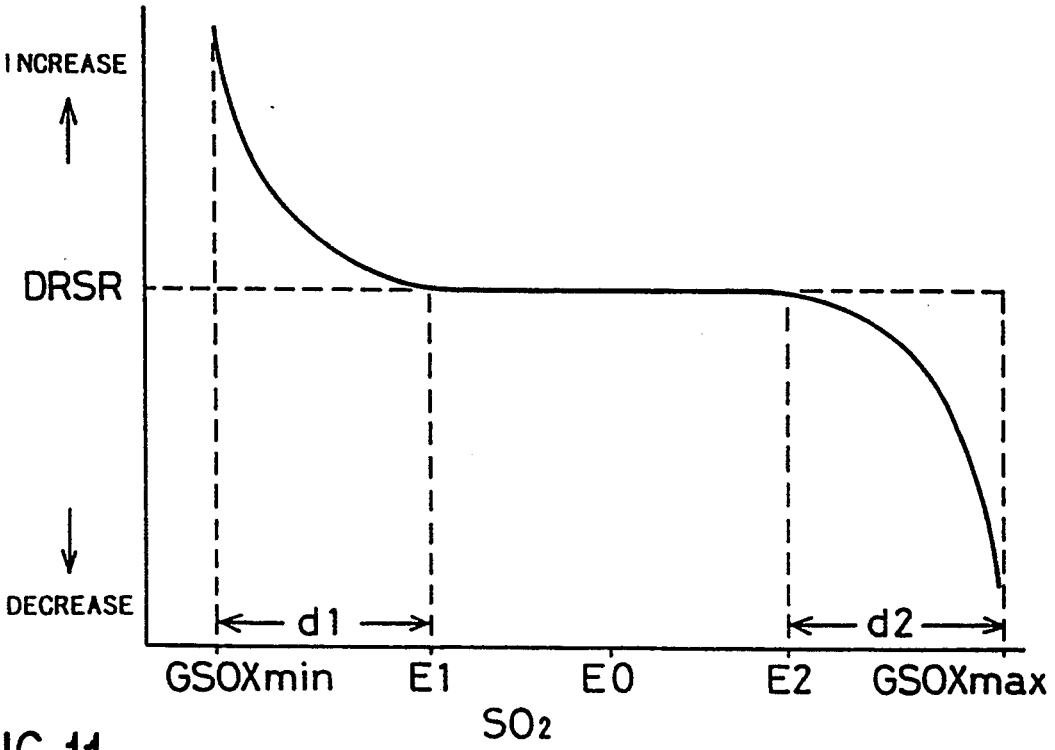
FIG. 11 is a graph showing a correlation of an output voltage sox of a second oxygen sensor 56 with the skip update quantity DRSR.

FIG. 11 shows a total relationship between the output voltage SOX of the second oxygen sensor 56 and the skip update quantity DRSR. AS shown in the graph of FIG. 11, when the output voltage SOX of the second oxygen sensor 56 is within a predetermined range between a first voltage E1 and a second voltage E2 including a reference voltage E0 (=0.45 [V]) corresponding to the stoichiometric air-fuel ratio, the update quantity DRSR of the rich skip amount RSR becomes equal to zero. The first voltage E1 is smaller than the reference voltage E0 and has a voltage difference of d1 from the minimum output GSOXmin of the second oxygen sensor 56 whereas the second voltage E2 is greater than the reference voltage E0 and has a voltage difference of d2 from the maximum output GSOXmax of the second oxygen sensor 56. When the output voltage SOX is in a range between the minimum output GSOXmin and the first voltage E1, the update quantity DRSR exponentially increases with a decrease in the voltage. When the output voltage SOX is in a range between the second voltage E2 and the maximum output GSOXmax, the update quantity DRSR exponentially decreases with an increase in the voltage. The correlation of the update quantity DRSR with the output voltage SOX thus determined corresponds to purification characteristics of the exhaust gas by the catalytic converter 16.

Figure 12:
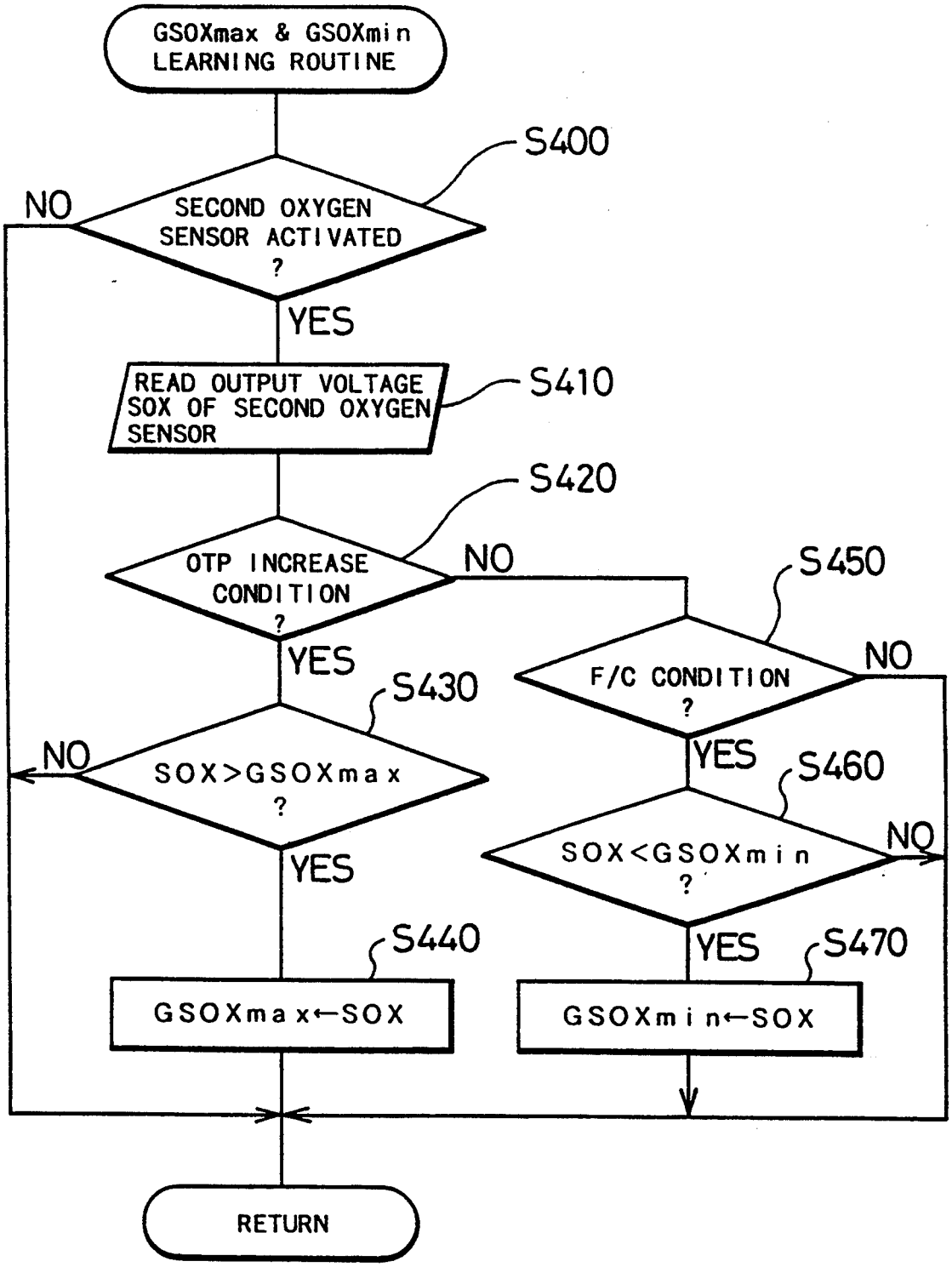
FIG. 12 is a flowchart showing a learning routine executed by the CPU for determining a maximum output GSOXmax and a minimum output GSOXmin.
Figure 13A:
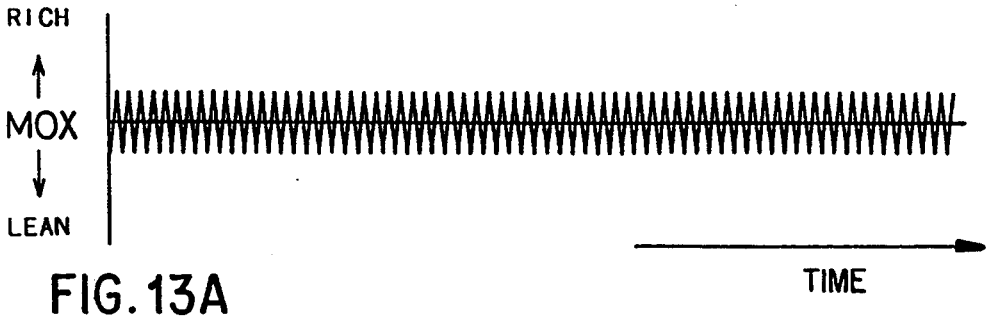
FIG. 13 is a timing chart showing variations according to the control processes executed by the CPU.
Figure 13B:
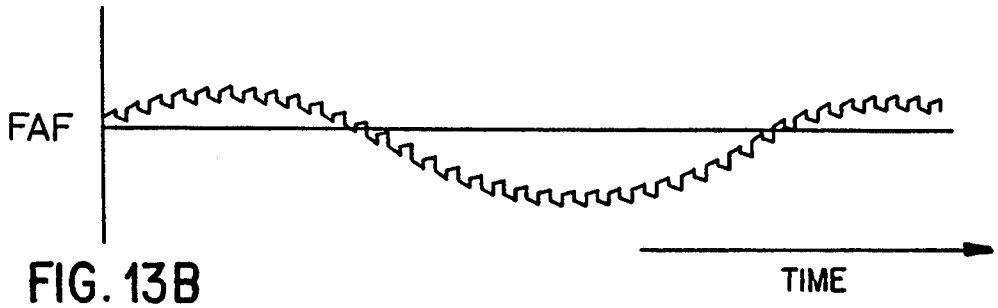
Figure 13C:
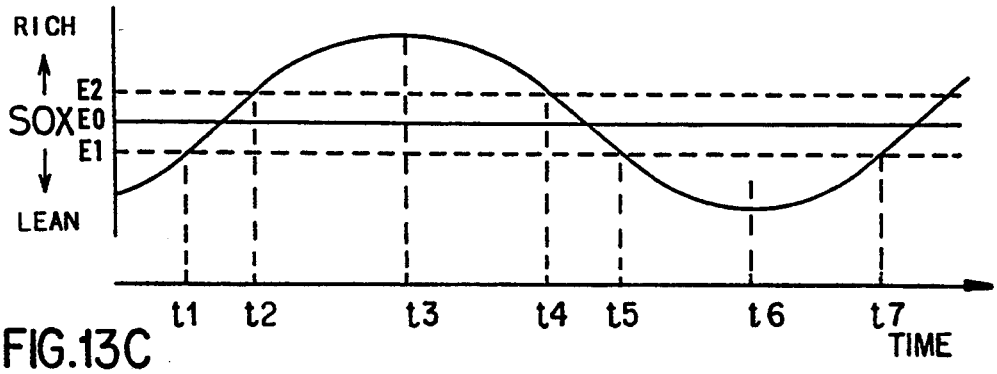
Figure 13D:
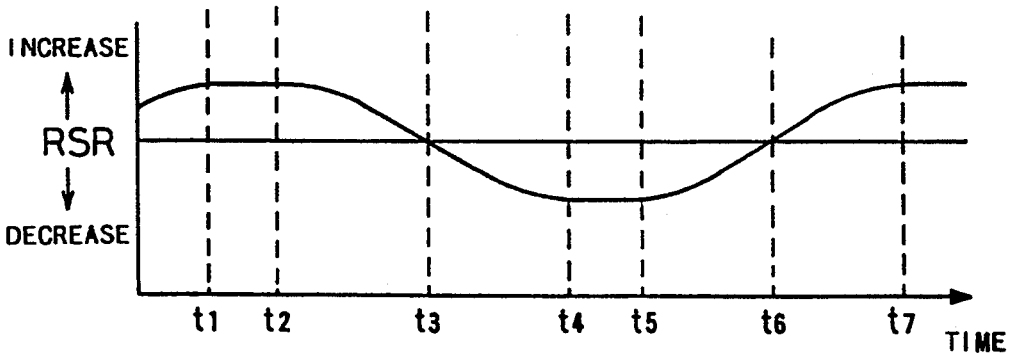

A learning routine for determining the maximum output GSOXmax and the minimum output GSOXmin of the second oxygen sensor 56 is explained based on the flowchart of FIG. 12. This learning routine is executed as interrupting at every predetermined time interval, for example, 512 millisecond.

When the program enters the routine, the CPU 70*a* first determines whether the second oxygen sensor 56 is activated at step S400. When the temperature of the cooling water is not higher than a predetermined value, for example, 70 [C], and the output voltage SOX is not inverted even at once, the oxygen sensor 56 is determined not to be activated. When the second oxygen sensor 56 is not activated, the program goes to RETURN to exit from the routine. When the second oxygen sensor 56 is determined to be activated at step S400, on the contrary, the program proceeds to step S410 at which the CPU 70*a* reads the output voltage SOX of the second oxygen sensor 56 input via the input process circuit 70*f*, out of the RAM 70*c*.

The CPU 70*a* then determines whether the fuel injection increases for the purpose of over temperature protection (hereinafter referred to as OTP). Under such a condition as the OTP increase in the fuel injection, the CPU 70*a* compares the SOX read at step S410 with the current maximum output GSOXmax at step S430. When the output voltage SOX is greater than GSOXmax at step S430, the program goes to step S440 at which the CPU 70*a* stores the output voltage SOX as an updated maximum output GSOXmax. When the output voltage SOX is not greater than GSOXmax at step S430, on the other hand, the maximum output GSOXmax is not updated and the program goes to RETURN to exit from the routine.

When the fuel injection is not under the 0TP increase condition at step S420, the program goes to step S450 at which the CPU 70*a* determines whether the engine 1 is under a fuel-cut condition. When the answer is YES, the program proceeds to step S460 at which the CPU 70*a* compares the output voltage SOX read at step S410 with the current minimum output GSOXmin. When the output voltage SOX is smaller than GSOXmin at step S460, the program goes to step S470 at which the CPU 70*a* stores the output voltage SOX as an updated minimum output GSOXmin. When the output voltage SOX is not smaller than GSOXmin at step S460, on the other hand, the minimum output GSOXmin is not updated and the program goes to RETURN to exit from the routine. When the CPU 70*a* determines that the engine 1 is not under the fuel-cut condition at step S450, the program also goes to RETURN to exit from the routine.

The learning routine described above determines the maximum output GSOXmax and the minimum output GSOXmin of the output voltage SOX of the second oxygen sensor 56. The CPU 70*a* learns the maximum output GSOXmax only under the OTP increase condition when the maximum output GSOXmax may be updated, and learns the minimum output GSOXmin only under the fuel-cut condition when the minimum output GSOXmin may be updated. The maxim output GSOXmax and the minimum output GSOXmin are cleared to zero in a routine (not shown) executed at a start-up of the engine 1. In the manner described above, the learning routine determines the maximum output GSOXmax and the minimum output GSOXmin in a predetermined time period from a start-up of the engine 1 to a stop of the engine 1.

FIG. 13 is a timing chart showing variations in the output voltage MOX of the first oxygen sensor 55, the output voltage SOX of the second oxygen sensor 56, the rich skip amount RSR, and the air-fuel ratio compensation coefficient FAF determined in the control routines executed by the CPU 70*a* of the ECU 70.

As clearly seen in the timing chart of FIG. 13, while the output voltage SOX of the second oxygen sensor 56 changes from a first voltage E1 to a second voltage E2 in a time period between a first time point t1 and a second time point t2 the update quantity DRSR of the rich skip amount RSR is equal to zero and the rich skip amount RSR is thereby maintained at a constant maximum value. The rich skip amount RSR gradually decreases after the output voltage SOX exceeding the second voltage E2, and shows a maximum variation when the output voltage SOX reaching a maximum at a third time point t3. The rich skip amount RSR continuously 20 decreases until the output voltage SOX of the second oxygen sensor 56 becomes equal to the second voltage E2 at a fourth time point t4 when the update quantity DRSR of the rich skip amount RSR becomes equal-to zero. While the output voltage SOX decreases from the second voltage E2 to the first voltage E1 at a fifth time point t5, the update quantity DRSR of the rich skip amount RSR is equal to zero and the rich skip amount RSR is maintained at a constant minimum value. The rich skip amount RSR gradually increases after the output voltage SOX becoming lower than the first voltage E1, and shows a maximum variation when the output voltage SOX reaching a minimum at a sixth time point t6. The rich skip amount RSR continuously increases until the output voltage SOX of the second oxygen sensor 56 becomes equal to the first voltage E1 at a seventh time point t7 when the update quantity DRSR of the rich skip amount RSR becomes equal to zero. After the seventh time point t7, the same cycle between t1 and t7 is repeated.

When the output voltage MOX of the first oxygen sensor 55 is varied, the air-fuel ratio compensation coefficient FAF is balanced around a certain characteristic line through repetition of the skip control including control of the rich skip amount RSR and the integral control as explained according to the timing chart of FIG. 7. The certain characteristic line is shifted with a time-based variation in the rich skip amount RSR.

As described above, when the output voltage SOX of the second oxygen sensor 56 is within a predetermined range between the first voltage E1 and the second voltage E2 including the reference voltage E0, the rich skip amount RSR is maintained at a constant value. This effectively prevents the air-fuel ratio from being compensated excessively and maintains a desirable condition where an exhaust of harmful gases including hydrocarbons, carbon monoxide, and nitrogen oxides is reduced. When the output voltage SOX is out of the predetermined range between E1 and E2, the update quantity DRSR of the rich skip amount RSR per unit time increases exponentially. This effectively prevents insufficient compensation of the air-fuel ratio and rapidly makes the air-fuel ratio close to a desirable target ratio where an exhaust of the harmful gases is reduced. The system of the embodiment eliminates a time lag of the output of the second oxygen sensor 56 at a high accuracy and adequately controls the air-fuel ratio of the engine 1, thus efficiently reducing an exhaust of the harmful gases including HC, CO, and NOx and improving the drivability and the fuel consumption.

The system of the embodiment determines the maximum output GSOXmax and the minimum output GSOXmin of the output voltage SOX of the second oxygen sensor 56 through learning, determines the difference DSOX between the maximum output GSOXmax or the minimum output GSOXmin and the output voltage SOX of the second oxygen sensor 56, and eventually determines the update quantity DRSR of the rich skip amount RSR according to the difference DSOX.

Figure 14A:
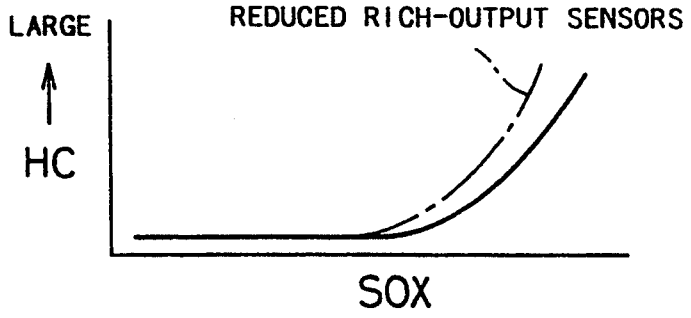
FIG. 14 is a graph showing a correlation of outputs of an oxygen sensor and amounts of exhaust emission.
Figure 14B:
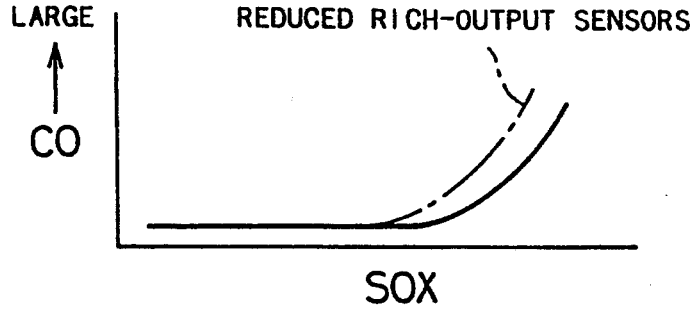
Figure 14C:
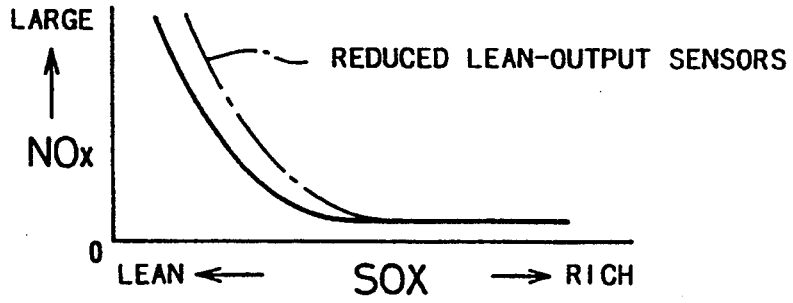

Oxygen sensors generally show reduced rich or lean outputs through long-term use. As shown in FIG. 14, the correlation characteristics of the output voltage (SOX of the second oxygen sensor 56) with exhaust emission of HC, CO, and NOx shift from Normal conditions shown by the solid lines to undesirable conditions shown by the one-dot chain lines in deteriorating rich- or lean-output oxygen sensors. As described above, the update quantity DRSR is determined according to the difference DSOX between the maximum output GSOXmax or the minimum output GSOXmin and the output voltage SOX actually measured. Even when the second oxygen sensor 56 has reduced rich and lean outputs through a long-term use, the update quantity DRSR depending upon the difference DSOX determined by using the maximum and the minimum of the reduced outputs as reference values is not affected by reduction of the rich and lean outputs. Even when the oxygen sensor deteriorates to show reduced rich and lean outputs through a long-term use, the update quantity DRSR of the rich skip amount RSR is effectively determined according to the exhaust emission characteristics or purification characteristics of the exhaust gas by the catalytic converter 16. This allows the air-fuel ratio to be controlled adequately.

Although the update quantity DRSR of the rich skip amount RSR is determined according to the difference DSOX in the auxiliary air-fuel ratio feed-back control routine of the above embodiment, an update quantity of the lean skip amount RSL may alternatively be determined to have the same effects as the above embodiment.

The inlet and outlet concentration sensors of the invention may be realized by CO sensors or lean mixture sensors instead of the oxygen sensors 55 and 56 of the above embodiment.

There may be many other alterations, changes, and modifications without departing from the scope or spirit of essential characteristics of the invention. It is thus clearly understood that the above embodiment is only illustrative and not restrictive in any sense. The spirit and scope of the present invention is limited only by the terms of the appended claims.

What is claimed is:

1. An air-fuel ratio control system for controlling an air-fuel ratio of an internal combustion engine, said system comprising:

a catalytic converter positioned in an exhaust conduit of said internal combustion engine;

a first concentration sensor disposed in an inlet position of said catalytic converter for detecting a first concentration of a specific component varying with change in an air-fuel ratio reflected in an exhaust gas;

a second concentration sensor disposed in an outlet position of said catalytic converter for detecting a second concentration of the specific component varying with change in the air-fuel ratio reflected in the exhaust gas;

control means for updating a first control amount corresponding to the first concentration of said specific component detected by said first concentration sensor, updating a second control amount corresponding to the second concentration of said specific component detected by said second concentration sensor, and controlling the air-fuel ratio of said internal combustion engine to a predetermined target air-fuel ratio according to the first and second control amounts;

memory means for previously storing correlation data representing a relationship between an air-fuel ratio at the outlet position where said second concentration sensor is disposed and an update quantity of said second control amount per unit time, which are correlated with each other in response to purification characteristics of the exhaust gas by said catalytic converter; and second control update means for determining, based on said correlation data stored in said memory means, the update quantity of said second control amount per unit time corresponding to the second concentration of said specific component detected by said second concentration sensor, so as to regulate said control means to update said second control amount based on said update quantity per unit time.

2. An air-fuel ratio control system in accordance with claim 1, wherein both said first concentration sensor and said second concentration sensor comprise oxygen sensors for respectively detecting concentrations of oxygen in the exhaust gas.

3. An air-fuel ratio control system in accordance with claim 2, wherein said correlation data stored in said memory means shows a minimum of the update quantity of said second control amount per unit time when the second concentration of said specific component detected by said second concentration sensor is within a predetermined range including a reference concentration corresponding to a stoichiometric air-fuel ratio.

4. An air-fuel ratio control system in accordance with claim 2, wherein said correlation data stored in said memory means shows an abrupt exponential change in the update quantity of said second control amount per unit time when the second concentration of said specific component detected by said second concentration sensor is out of a predetermined range including a reference concentration corresponding to a stoichiometric air-fuel ratio.

5. An air-fuel ratio control system in accordance with claim 2, wherein said correlation data stored in said memory means shows a minimum of the update quantity of said second control amount per unit time when the second concentration of said specific component detected by said second concentration sensor is within a predetermined range including a reference concentration corresponding to a stoichiometric air-fuel ratio, and shows an abrupt exponential change in the update quantity of said second control amount per unit time when the second concentration of said specific component is out of said predetermined range.

6. An air-fuel ratio control system in accordance with claim 5, wherein said first control amount updated by said control means comprises a skip amount which skippingly varies an air-fuel ratio compensation and an integral amount which gradually varies the air-fuel ratio compensation, and said second control amount updated by said control means comprises a skip compensation which compensates for said skip amount.

7. An air-fuel ratio control system in accordance with claim 6, wherein said skip compensation compensates either a rich skip amount which varies the air-fuel ratio to a rich condition or a lean skip amount which varies the air-fuel ratio to a lean condition.

8. An air-fuel ratio control system in accordance with claim 2, said system further comprising:

learning means for learning a maximum and a minimum of the second concentration of said specific component detected by said second concentration sensor;

wherein said second control update means comprises an update quantity determination unit for calculating at least one of first and second differences, said first difference being between said maximum and the second concentration of said specific component detected by said second concentration sensor, said second difference being between said minimum and said second concentration, and determining the update quantity of said second control amount per unit time based on said differences.

9. An air-fuel ratio control system in accordance with claim 8, said system further comprising:

start-up detection means for detecting a start-up of said internal combustion engine; and clear means for clearing the maximum and the minimum of the second concentration of said specific component learnt by said learning means when a start-up of said internal combustion engine is detected.

10. An air-fuel ratio control system in accordance with claim 9, wherein said learning means further comprises:

first decision unit for determining whether said internal combustion engine is under such an operating condition that fuel injection increases for the purpose of preventing an abnormal overheat;

maximum learning means for learning the maximum of the second concentration of said specific component only when said first decision means determines an increase in the fuel injection;

second decision means for determining whether said internal combustion engine is under a fuel-cut condition; and minimum learning means for learning the minimum of the second concentration of said specific component only when said second decision means determines a fuel-cut condition.

11. A method of controlling an air-fuel ration in an internal combustion engine, said method comprising the steps of:

(a) detecting a first concentration of a specific component varying with change in an air-fuel ratio reflected in an exhaust gas at an inlet position of a catalytic converter positioned in an exhaust conduit of said internal combustion engine;

(b) detecting a second concentration of the specific component varying with change in the air-fuel ratio reflected in the exhaust gas at an outlet position of said catalytic converter;

(c) updating a first control amount corresponding to the first concentration of said specific component detected in step (a), updating a second control amount corresponding to the second concentration of said specific component detected in step (b), and controlling the air-fuel ratio of said internal combustion engine to a predetermined target air-fuel ratio according to the first and second control amounts;

(d) previously storing correlation data representing a relationship between an air-fuel ratio at the outlet position for detection in step (b) and an update quantity of said second control amount per unit time, which are correlated with each other in response to purification characteristics of the exhaust gas by said catalytic converter; and (e) determining, based on said correlation data stored in step (d), the update quantity of said second control amount per unit time corresponding to the second concentration of said specific component detected in step (b), so as to regulate updating of said second control amount executed in step (c) based on said update quantity per unit time.

12. A method in accordance with claim 11, wherein both the first and second concentrations of said specific component detected in step (b) and step (c) are concentrations of oxygen.

13. A method in accordance with claim 12, wherein said correlation data stored in step (d) shows a minimum of the update quantity of said second control amount per unit time when the second concentration of said specific component detected in step (b) is within a predetermined range including a reference concentration corresponding to a stoichiometric air-fuel ratio.

14. A method in accordance with claim 12, wherein said correlation data stored in step (d) shows an abrupt exponential change in the update quantity of said second control amount per unit time when the second concentration of said specific component detected in step (b) is out of a predetermined range including a reference concentration corresponding to a stoichiometric air-fuel ratio.

15. A method in accordance with claim 12, wherein said correlation data stored in step (d) shows a minimum of the update quantity of said second control amount per unit time when the second concentration of said specific component detected in step (b) is within a predetermined range including a reference concentration corresponding to a stoichiometric air-fuel ratio, and shows an abrupt exponential change in the update quantity of said second control amount per unit time when the second concentration of said specific component is out of said predetermined range.

16. A method in accordance with claim 15, wherein said first control amount updated in step (c) comprises a skip amount which skippingly varies an air-fuel ratio compensation and an integral amount which gradually varies the air-fuel ratio compensation, and said second control amount updated in step (c) comprises a skip compensation which compensates for said skip amount.

17. A method in accordance with claim 16, wherein said skip compensation compensates either a rich skip amount which varies the air-fuel ratio to a rich condition or a lean skip amount which varies the air-fuel ratio to a lean condition.

18. A method in accordance with claim 12, said method further comprising the step of:

(f) learning a maximum and a minimum of the second concentration of said specific component detected in step (b);

wherein step (e) further comprises the step of:

(e-1) calculating at least one of first and second differences, said first difference being between said maximum and the second concentration of said specific component detected in step (b), said second difference being between said minimum and said second concentration, and determining the update quantity of said second control amount per unit time based on said differences.

19. A method in accordance with claim 18, said method further comprising the steps of:

(g) detecting a start-up of said internal combustion engine; and (h) clearing the maximum and the minimum of the second concentration of said specific component learnt in step (f) when a start-up of said internal combustion engine is detected.

20. A method in accordance with claim 19, wherein step (f) further comprises the steps of:

(f-1) determining whether said internal combustion engine is under such an operating condition that fuel injection is increased for preventing an abnormal overheat;

(f-2) learning the maximum of the second concentration of said specific component only when an increase in the fuel injection is determined in step (f-1);

(f-3) determining whether said internal combustion engine is under a fuel-cut condition that fuel injection is reduced; and (f-4) learning the minimum of the second concentration of said specific component only when a fuel-cut condition is determined in step (f-2).

* * * * *